US012674379B2

(12) United States Patent
Lo et al.

(10) Patent No.: US 12,674,379 B2
(45) Date of Patent: Jul. 7, 2026

(54) METHODS AND SYSTEMS FOR FRACING

(71) Applicant: Vertice Oil Tools, Inc., Stafford, TX (US)

(72) Inventors: Mike Lo, Houston, TX (US); Stephen Parks, Houston, TX (US); Mohamed Saraya, Sugar Land, TX (US)

(73) Assignee: HANGZHOU GUANGLI TECHNOLOGY CO., LTD., Missouri City, TX (US)

( * ) Notice: Subject to any disclaimer, the term of this patent is extended or adjusted under 35 U.S.C. 154(b) by 0 days.

(21) Appl. No.: 18/215,281

(22) Filed: Jun. 28, 2023

(65) Prior Publication Data

US 2023/0340867 A1 Oct. 26, 2023

Related U.S. Application Data

(63) Continuation-in-part of application No. 17/735,545, filed on May 3, 2022, now Pat. No. 11,846,171, which is a continuation of application No. PCT/US2022/013005, filed on Jan. 19, 2022, which is a continuation-in-part of application No. 17/175,864, filed on Feb. 15, 2021, now Pat. No. 11,555,377.

(51) Int. Cl.

| | |
|---|---|
| ***E21B 43/26*** | (2006.01) |
| ***E21B 33/12*** | (2006.01) |
| ***E21B 33/129*** | (2006.01) |
| ***E21B 33/13*** | (2006.01) |
| ***E21B 34/14*** | (2006.01) |

(52) U.S. Cl.
CPC ..... *E21B 43/261* (2013.01); *E21B 33/1294* (2013.01); *E21B 33/12* (2013.01); *E21B 33/13* (2013.01); *E21B 34/142* (2020.05); *E21B 2200/05* (2020.05); *E21B 2200/08* (2020.05)

(58) Field of Classification Search
CPC ..... E21B 43/261; E21B 33/1294; E21B 2200/08; E21B 2200/05; E21B 34/142; E21B 33/12; E21B 33/13
See application file for complete search history.

(56) References Cited

U.S. PATENT DOCUMENTS

| | | | | |
|---|---|---|---|---|
| 2,407,081 A * | 9/1946 | Johnston | E21B 43/116 175/4.58 |
| 4,805,726 A * | 2/1989 | Taylor | G01V 1/133 367/146 |
| 4,846,281 A * | 7/1989 | Clary | E21B 34/12 166/373 |
| 7,152,688 B2 * | 12/2006 | Richards | E21B 34/10 166/332.8 |
| 2006/0169464 A1 * | 8/2006 | Richards | E21B 43/045 166/332.8 |
| 2006/0196676 A1 * | 9/2006 | Stoesz | E21B 34/14 166/242.7 |
| 2008/0169105 A1 * | 7/2008 | Williamson | E21B 33/1294 166/374 |

(Continued)

*Primary Examiner* — Neel Girish Patel
(74) *Attorney, Agent, or Firm* — Pierson IP, PLLC

(57) ABSTRACT

A downhole tool with an object positioned within a shearable housing. More specifically, embodiments are directed towards an upper portion of the shearable housing that is configured to be separated from an insert responsive to flowing back through the frac plug.

5 Claims, 11 Drawing Sheets

(56) References Cited

U.S. PATENT DOCUMENTS

2011/0198096 A1* 8/2011 Mailand ..... E21B 34/14 166/334.1
2012/0037373 A1* 2/2012 Xu ..... E21B 21/103 166/308.1
2012/0085548 A1* 4/2012 Fleckenstein ..... E21B 34/14 166/194
2012/0279700 A1* 11/2012 Frazier ..... E21B 34/063 166/192
2013/0014958 A1* 1/2013 Jani ..... E21B 33/134 166/98
2013/0020089 A1* 1/2013 Xu ..... E21B 34/102 166/373
2013/0240203 A1* 9/2013 Frazier ..... E21B 33/134 166/192
2013/0319668 A1* 12/2013 Tschetter ..... E21B 43/261 166/281
2014/0251612 A1* 9/2014 Powers ..... E21B 33/1208 166/179
2014/0262331 A1* 9/2014 Jordan, Jr. ..... E21B 23/02 166/242.1
2015/0068727 A1* 3/2015 Hem ..... E21B 23/08 166/114
2015/0147495 A1* 5/2015 Kumar ..... B32B 1/00 428/408
2015/0330181 A1* 11/2015 Budde ..... E21B 23/06 166/185
2016/0084040 A1* 3/2016 Brasseaux ..... E21B 34/10 166/194
2016/0108711 A1* 4/2016 Lynk ..... E21B 33/13 166/308.1
2016/0258259 A1* 9/2016 Walton ..... E21B 34/066
2017/0089175 A1* 3/2017 Doane ..... E21B 23/006
2017/0175487 A1* 6/2017 Marcin ..... E21B 34/14
2017/0335644 A1* 11/2017 Ciezobka ..... E21B 47/04
2018/0051532 A1* 2/2018 Smith ..... E21B 34/10
2019/0186223 A1* 6/2019 Mhaskar ..... E21B 33/134
2020/0072008 A1* 3/2020 Dirocco ..... E21B 33/10
2020/0072020 A1* 3/2020 Dirocco ..... E21B 33/134
2020/0095855 A1* 3/2020 Hughes ..... E21B 23/10
2020/0190928 A1* 6/2020 King ..... E21B 29/002

* cited by examiner

METHODS AND SYSTEMS FOR FRACING

BACKGROUND INFORMATION

Field of the Disclosure

Examples of the present disclosure relate to a downhole tool with a flapper positioned within a shearable housing. More specifically, embodiments are directed towards an upper portion of the shearable housing that is configured to shear in a first direction while retaining pressure and isolating a first area above the housing from a second area below the housing after being sheared, and to be separated responsive to flowing back through the downhole tool to allow communication between the first area and the second area.

Background

Conventionally, after casing and cementing a well and to achieve Frac/zonal isolation in a Frac operation, a frac plug and perforations on a wireline are pushed/pumped downhole to a desired a depth. Then, a frac plug is set and perforation guns are fired above to create conduit to frac fluid. This enables the fracing fluid to be pumped to the newly created conduit while isolating it from zones below using the frac plug. Typically, to aid in allowing the assembly of perforation and frac plug to reach the desired depth, specifically in horizontal or deviated laterals, pumping operation can be used. During the pumping operation the wireline is pumped down hole with the aid of flowing fluid.

Conventional flac plugs utilize a ball that is dropped from surface and isolate on the frac plug, this ensure a contingency of pumping another plug or downhole tools is available in case the gun misfire, this require pumping the ball from surface which consume time and fluid, if the ball is run on the seat with the frac plug then it requires the well to be flow back in case of gun misfire, this can be somewhat challenging if the well doesn't possess enough energy to flow. Having a ball trap in the running tool is a solution, yet it still requires certain flow rate to allow the ball to flow back. Further, some other plugs utilize rupture discs that rupture based on a pressure differential between the zones above and below the frac plug to establish communication across the rupture disc. However, this creates scalable problems, where each stage of a wellbore requires rupture discs of different values. This can also cause situations where rupture discs may prematurely break.

Accordingly, needs exist for systems and methods utilizing a downhole tool with a shearable housing configured to hold a flapper, wherein the housing is configured to separate into a lower portion and upper portion based upon a pressure applied to stress points on the housing. Furthermore, needs exist for the flapper to be separated from the lower portion of the housing responsive to flowing back through the downhole tool, wherein the lower portion may also be separated from the flapper responsive to the flowing back.

Further, in other applications and after activating the toe sleeve, needs exist to test the casing to maximum operating pressure before starting the standard operation of perforating and pumping stimulation fluid. Currently, to test a maximum operation pressure a dissolvable ball is pumped downhole, lands on a ball seat located just above the toe sleeve. Then, the casing is then tested and the ball is allowed to dissolve, this may take few days, weeks before it dissolves. If the ball doesn't dissolve, communication with the toe sleeve is lost, and intervention with coiled tubing, stick pipe or any other conveying method to re-open or perforate the casing above the ball is necessary. Hence, needs exist to have a down hole tool that can be equipped with the shearable housing that may seat on the down hole internal diameter restriction (ball seat) and allow the casing to be tested instantly while establishing communication with toe sleeve instantly by flowing back through down hole tool. Making this tool acts like the first frac plug in the well.

SUMMARY

Embodiments disclosed herein describe systems and methods for a downhole tool. The downhole tool may include a mandrel, insert, housing, flapper or a disc, cones, upper and lower slips, bottom guide that makes a frac plug.

In other embodiments, the mandrel may be a shaft, cylindrical rod, cartridge, etc. that is configured to form a body or the whole tool of a downhole tool, such as a frac plug, sliding sleeve, or cartridge. The mandrel may include a profile that reduces an inner diameter of the mandrel that limits the movement of the insert in a first direction. The profile may be a ledge that is perpendicular to a central axis of the downhole tool or may be a tapered sidewall that gradually and incrementally decreases the inner diameter of the mandrel.

The insert may be configured to be mounted on and positioned inside or adjacent to the inner diameter of the mandrel. The insert may include a ledge, sloped sidewall, distal end, and pin slots. The ledge may decrease an inner diameter across the insert, wherein the ledge is configured to receive a projection of the upper portion of the housing. Responsive to positioning the projection of the upper portion of the housing on the ledge, movement of the upper portion of the housing in a first direction may be limited. Furthermore, when the upper portion of the housing and the lower portion of the housing are coupled together, the ledge may restrict the movement of the entire housing in the first direction before the lower portion of the housing shears from the upper portion of the housing.

The sloped sidewall may be configured to gradually decrease the inner diameter of the insert, wherein the angle of the sloped sidewall may correspond to the tapered sidewall of the mandrel. This may enable a seal to be formed between the insert and the mandrel. Furthermore, the inner sloped sidewall may be configured to limit the movement of the lower portion of the housing after the upper portion of the housing and the upper portion of the housing have been decoupled, sheared, etc.

The distal end of the insert may project away from an inner diameter of the mandrel, wherein the distal end of the insert may be configured to limit the movement of the lower portion of the housing in a second direction. Furthermore, when the upper portion of the housing and the lower portion of the housing are coupled together, the distal end may restrict the movement of the entire housing in the second direction due to locking projections on the lower portion of the housing.

The pin slots may be indentations, grooves, cutouts positioned within the insert. The pin slots may be configured to selectively receive the flapper pin to couple the flapper and the insert together. In embodiments, the pin slots may be configured to be covered by the upper portion of the housing when the upper portion of the housing and the lower portion of the housing are coupled together. After the flapper pin has been dislodged from the pin slots, it will be very unlikely for the flapper pin to realign and be positioned within the pin slots. Therefore the flapper will be very unlikely able to seat on the lower portion of the housing and seal again. In embodiments, the flapper pin may be configured to be dislodged from the pin slots responsive to shearing the upper portion of the housing and the lower portion of the housing, and removing the upper portion of the housing from the insert and the flapper via flow back of the well. In other embodiments, the flapper and the pin may be replaced with a disc with any geometry, i.e.: flat, cube, rounded or combination of any of these.

The housing may be configured to be positioned on insert, wherein the housing is radially positioned within the housing. However, in alternative embodiments without an insert, the housing may be directly positioned on the inner diameter of the mandrel. In these embodiments, the mandrel may include similar geometries of those described above regarding the mandrel. The housing may include a flapper or a disc, upper portion, and lower portion.

The flapper or object (referred to hereinafter collectively and individually as "flapper") may be configured to rotate from a position blocking an inner diameter of the downhole tool to a position allowing fluid to flow around the flapper, wherein the object is positioned radially within the housing. However, in other embodiments, the flapper may be any object of any geometry that is configured to isolate a first area above the housing from a second area below the housing. The flapper may be mounted inside the housing, and run in hole in the closed position. The flapper or any other object may be positioned within housing and positioned in the closed position before the housing is positioned downhole. This may enable the object to be pumped downhole along with the housing in the closed position. This may eliminate the need to drop balls downhole to isolate the wellbore or require shifting tools to set a flapper downhole. By positioning the flapper in the closed positioned within the housing before positioning the housing within the hole or down well, there is no need to drop and pump a dissolvable ball downhole. Nor is necessary to wait a few days to allow the ball to dissolve to allow for pumping. By positioning the object within the housing or directly on the mandrel, the ability to pump may be established directly after testing. Additionally, when the flapper is positioned across the housing, the flapper may be configured to be positioned on a flapper seat on the lower portion of the housing. Forces applied by the flapper in the first direction against the flapper seat may be utilized to shear the upper portion of the housing from the lower portion of the housing.

In embodiments, the flapper may include a flapper pin that defines a rotational axis of the flapper, wherein ends of the flapper pin are configured to be positioned through the housing and within pin slots on the insert. Responsive to the ends of the flapper pins being inserted into the pin slots, the flapper and the housing may be coupled together. In embodiments, the flapper pin may be removably inserted into the flapper or may be fixed within the flapper.

In embodiments, the mandrel may have one or more holes that may create a throttle to create a pressure differential across the flapper while pumping fluid. This may aid or cause the housing to shear to upper and lower portion, where the lower portion will cover the holes and seal upper area above the flapper/object from the lower area below the object.

The upper portion of the housing may have a projection and stress points. The projection may increase an outer diameter of the upper portion, wherein the projection may be configured sit on a ledge of the insert. When the projection is positioned on the ledge of the insert, the movement of the upper portion of the housing in the first direction may be restricted.

The stress points may be positioned between the upper portion of the housing and the lower portion of the housing, and may be weak points. The weak points may be locations where upper portion of housing may be separated from the lower portion of housing. The stress points may be positioned adjacent to openings, windows, etc. that are exposed to the inner diameter of the tool above the flapper. When exposed to fluid flowing/pressure through the inner diameter of the downhole tool in the first direction may cause the pressure applied to the stress points to be greater than a stress threshold. Responsive the pressure applied to the stress points being greater than the stress threshold, upper portion and lower portion of housing may become detached and separated. Then, lower portion of housing may move in the first direction to be positioned on the sloped sidewall of the insert. In other embodiment, the lower and upper portions of the housing maybe separate elements connected together via shear pins or any other coupling mechanisms that become the weak points and break, wherein responsive to the coupling mechanisms breaking based on a force applied by the flapper the upper and lower portions of the housing may separate.

Lower portion of the housing may include a seal, flapper seat, locking outcrops. The seal may be configured to be positioned between an outer diameter of the lower portion of housing and on inner diameter of the inset. This may not allow communication through a gap between the insert and the housing when the lower portion is positioned on the insert.

The flapper seat may be configured to reduce the inner diameter of the housing to receive the flapper when the flapper is extended across the housing. Furthermore, the flapper seat may be configured to receive forces from the flapper in the first direction to shear the upper portion of the housing from the lower portion of the housing. In embodiments, a thickness associated with the flapper seat may be larger than that of the stress points.

The locking outcrops may be positioned on the distal end of the housing below the distal end of the insert, and increase an outer diameter of the lower portion of the housing. The outer diameter associated with locking outcrops may be larger than the inner diameter of the distal end of the insert. Due to the locking outcrops being larger in size than that of the inner diameter of the distal end of the insert, the locking outcrops may restrict the movement of lower portion of the housing in a second direction. This may assist in the disengaging the upper portion of the housing from the lower portion of the housing when there is a flow back through the housing, while retaining lower portion of the housing within the insert in both directions after lower portion of the housing separates from the upper portion of the housing.

In embodiments, the housing may be configured to be run in hole. When the downhole tool is run in hole, the flapper may be configured to be positioned in a closed position, which may isolate an area below the flapper from an area above the flapper. Once the downhole tool has reached a desired depth and been set in the casing, a pressure above the flapper may increase past a stress threshold. Responsive to the pressure increasing past the stress threshold, the upper portion of the housing may remain fixed in place while the lower portion of the housing may slide in first direction while remaining inside of the insert, wherein the first direction is a downhole direction. Hence, isolating the pressure above the flapper from zones below the downhole tool even after the upper portion of the housing has been decoupled from the lower portions of the housing, while the upper portion of the housing remains within the insert or the mandrel. Operations may be later performed to equalize the pressure across the housing or flow back fluid uphole, which may allow the upper portion of the housing and the flapper/disc to become disengage.

When the upper portion of the housing and the flapper are positioned after flow in the second direction or bleeding off pressure above the housing and the flapper, an area above the insert may be in communication with an area below the insert. Furthermore, because of the geometries of the flapper/disc, upper portion of the housing, and the lower portion of the housing it is unlikely that the separated parts may become aligned again. This may maintain the communication across the insert and or directly through the internal diameter of the mandrel.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
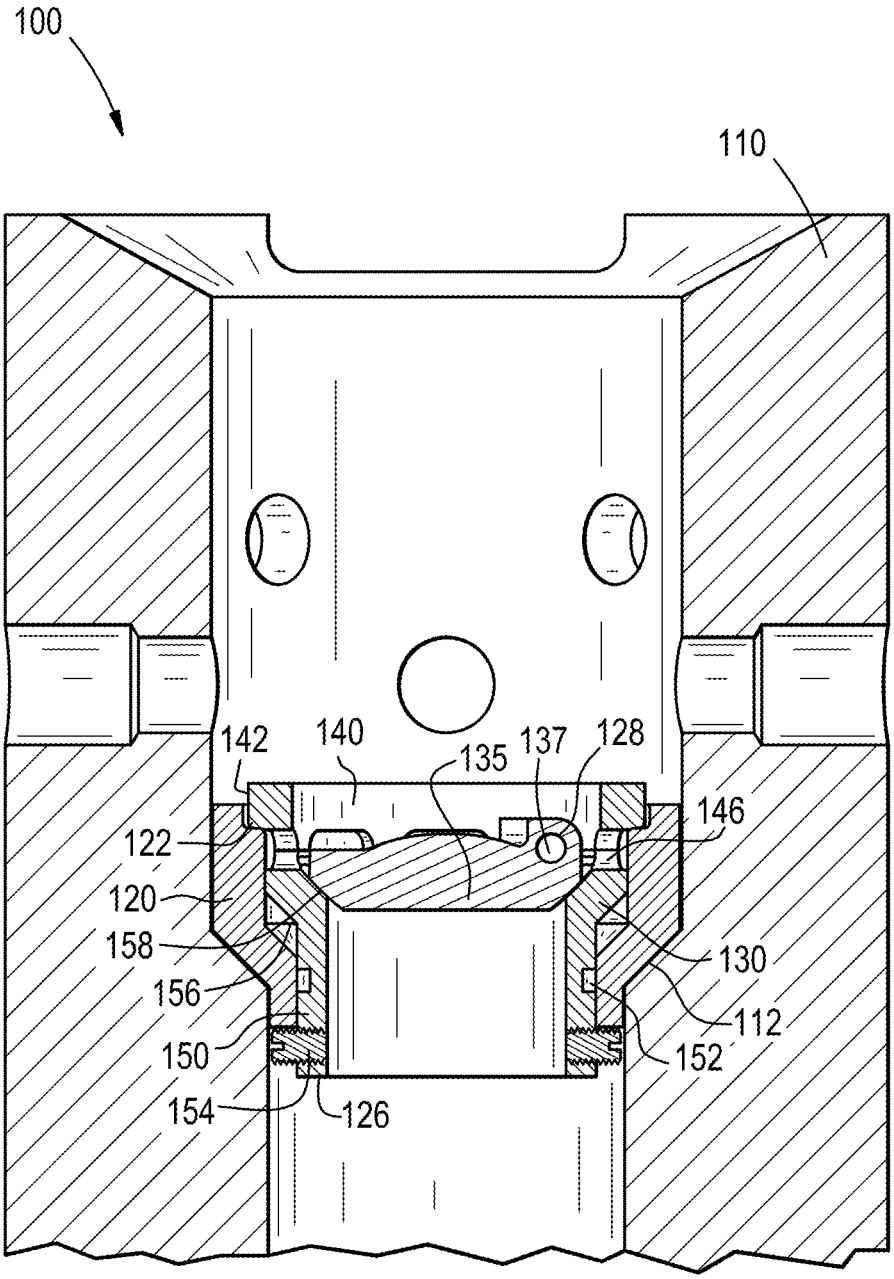
FIG. 1 depicts a downhole tool, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

FIG. 1 depicts a downhole tool 100, according to an embodiment. Downhole tool 100 may be a downhole tool that is configured to isolate areas of a geological formation. For example, downhole tool 100 may be a frac plug, sliding sleeve, cartridge, tubing, etc. Downhole tool 100 may enable an object to be positioned within housing and positioned in the closed position before the housing is positioned downhole. This may enable the object to be pumped downhole along with the housing in the closed position, eliminating the need to drop balls downhole to isolate the wellbore or require shifting tools to set a flapper downhole. Further, by positioning the in the closed positioned within the housing before positioning the housing within the hole or down well, there is no need to drop and pump a dissolvable ball downhole. Accordingly, there will be no need for a waiting period for the ball to dissolve to allow for pumping. By positioning the object within the housing before positioning the housing downhole, the ability to pump may be established directly after testing while also reducing the need to pump additional tools downhole.

Downhole tool 100 may include a mandrel 110, insert 120, and housing 130.

Mandrel 110 may be a shaft, sliding sleeve, cartridge, cylindrical, rod, etc. that is configured to form a body of downhole tool 100. Mandrel 110 may include a profile 112 that reduces an inner diameter of mandrel 110 that limits the movement of insert 120 in a first direction. Profile 112 may be a keys or ledge that is perpendicular to a central axis of downhole tool 100, may be a tapered sidewall that gradually and incrementally decreases the inner diameter of mandrel 110, or any profile that changes an inner diameter of mandrel 110.

Insert 120 may be a tool formed of composite material, or any desired material, such as dissolvable. Insert 120 may be configured to be mounted on an inner diameter of mandrel 110 of downhole tool 100. In other embodiments, insert 120 may be a dart, cartridge, or sliding sleeve that is configured encompass housing 130, and be pumped downhole after mandrel 110 or casing is positioned at a desired location. In specific embodiments, insert 120 may be a cartridge with external keys that is configured to land on a desired location within mandrel 110. Insert 120 may include ledge 122, sloped sidewall 124, distal end 126, and pin slots 128. Insert 120 may be threaded, glued or pinned or fixed to Mandrel 110 using any other method.

Ledge 122 may decrease an inner diameter across insert 120, which may be configured to act as a stopper, no-go, etc. to restrict the movement of an upper portion of housing 130 in a first direction, wherein the first direction may be downhole. In other embodiments, ledge 122 may be keys or profiles that are configured to latch with corresponding keys on insert 120. More specifically, ledge 122 may be configured to receive a projection 142 of upper portion 140 of the housing 130. Responsive to positioning projection 142 of upper portion 140 on ledge 122, movement of housing 130 in the first direction may be restricted when upper portion 140 and lower portion 150 are coupled together. However, when upper portion 140 and lower portion 150 are decoupled, ledge 122 may not restrict the movement of lower portion 150 in the first direction.

Sloped sidewall 124 may be configured to gradually decrease the inner diameter of the insert 120. Sloped sidewall 124 may be configured to receive lower portion 150 of housing 130 to restrict the movement of lower portion 150 in the first direction responsive to decoupling upper portion 140 and lower portion 150. In embodiments, an angle of the sloped sidewall may correspond to the tapered sidewall of mandrel 110. Furthermore, a seal may be formed between an outer diameter of lower portion 150 and an inner diameter of insert 120 when lower portion 150 and upper portion 140 are decoupled.

The distal end 126 of the insert 120 may project away from an inner diameter of the mandrel 110 to create a lower shelf. Distal end 126 may be configured to interface with elements locking outcrops 154 of lower portion 150 to limit the movement of lower portion 150 in a second direction. In certain embodiments, tool 100 may not include an insert 120 and housing 130 may be directly mounted on mandrel 110, wherein mandrel 110 may have a similar inner profile as that described above.

Pin slots 128 may be holes, slots, indentations, etc. positioned through insert that are configured to selectively receive flapper pin 137. Specifically, pin slots 128 may have a first end that is positioned on the proximal end of insert 120 and extend towards a distal end of insert 120. Pin slots 128 may extend in a linear path with a larger length than that of flapper pin 137, which may allow flapper pin 137 to be free floating within pin slots 128. The proximal end of pin slots 128 may be configured to be contained between the upper portion 140 and lower portion 150 of housing 130 when upper portion 140 and lower portion 150 are coupled together. After flapper pin 137 is disengaged from pin slots 128 it may be unlikely that flapper pin 137 can reengage with pin slots 128 downwell.

Housing 130 may be formed of brass, composite, aluminum, cast iron or any other material that can dissolve over time due well fluid and temperature. Housing 130 may be a unified component that is configured to be positioned within a cartridge, insert, 120 or mandrel 110. Housing 130 may be configured to be positioned within insert 120 when run in hole, wherein elements of housing 130 may all be coupled together when run in hole. Accordingly, flapper 135 or another object may be positioned within housing 130 before housing 130 is positioned downhole. The housing 130 may include a flapper 135, upper portion 140, and lower portion 150. In other embodiments, the flapper 135 and flapper pin 137 may be replaced by disc or any geometrical shape.

Flapper 135 may be a rotatable disc formed of brass, composite, aluminum, cast iron or any other material that can dissolve over time due well fluid and temperature. Flapper 135 may be configured to rotate from a position blocking an inner diameter of the tool 100 to a position allowing fluid to flow around flapper 135. When flapper 135 extends across an annulus within tool, flapper 135 may be configured to be positioned on a flapper seat 158 within the lower portion of housing. When flapper 135 is positioned on flapper seat 158, whether upper portion 140 and lower portion 150 are coupled or decoupled from each other, a first area on a first side of flapper 135 may be isolated from a second area on a second side of flapper 135. However, if flapper 135 is rotated to not extend across the annulus within tool 100 and/or upper portion 140 is not positioned within insert 120, then the first area and second area may not be isolated from each other. Flapper 135 may be a free floating component that is mounted inside the housing 130 via a flapper pin 137 and insert 120. Flapper 135 may be configured to apply forces when pressure or forces are applied to flapper 135 from above against stress points 146 within housing 130 to separate upper portion 140 and lower portion 150 of housing.

Flapper pin 137 may be a free floating, which enables flapper 135 to move along a linear axis confined by pin slots 128. Flapper pin 137 configured to extend across an entirety of the diameter of housing and have ends that are configured to be inserted into pin slots 128. When flapper pin 137 is inserted into the pin slots 128, flapper 135 may be couple housing 130 and insert 120. In embodiments, flapper pin 137 may be an integral portion of flapper 135 or may be removably coupled to flapper 135, such that flapper pin 137 may slide out of flapper 135.

Upper portion 140 of housing 130 may be configured to be selectively coupled to lower portion 150 of housing 130 based on a pressure applied across housing 130 and a direction of fluid flowing within tool 100. Upper portion 140 may include projection 142 and stress points 146. In other embodiments, upper portion 140 and lower portion 150 may be two elements connected together via weak point 146 which can be a shear screw.

Projection 142 may be positioned on a proximal end of upper portion 140 and project away from a central axis of housing 130 to increase an outer diameter of upper portion 140. Projection 142 may be configured to slide onto and sit on ledge 122. Responsive to positioning projection 142 on ledge 122, movement of upper portion 140 in the first direction may be limited.

Stress points 146 may be positioned between upper portion 140 and lower portion 150 of housing 130. Stress points 146 may be weak points where upper portion 140 becomes disconnected from lower portion 150. In embodiments, stress points 146 may be configured to receive a force from flapper 135 against flapper seat 158 responsive to moving the free floating flapper 135 to be positioned on flapper seat 158. More specifically, when fluid is flowing through the inner diameter of tool 100, flapper 135 may receive forces created by the flowing fluid/pressure. This may allow flapper 135 to seat on the lower portion 150 of the housing 130, and cause flapper 135 to apply a pressure against the stress points 146. When flapper 135 applies a pressure greater than a stress threshold of stress points 146, stress points 146 may break causing upper portion 140 and lower portion 150 to become detached and separated. Then, lower portion 150 of housing may move in the first direction towards the distal end of the housing 130 with the flapper 135 and flapper pin 137. In other embodiments, the pressure on flapper 135 may be direct result of applying pressure above flapper 135 without having to flow fluid through inner diameter of tool 100.

Lower portion 150 of housing 130 may be configured to be selectively coupled to upper portion 140 of housing 130. Lower portion 150 may include seal 152, locking outcrops 154, and tapered sidewall 156. Seal 152 may be configured to be positioned between an outer diameter of the lower portion 150 and an inner diameter of inset 120. Seal 152 may not allow communication through a gap between insert 120 and housing 130 when lower portion 150 is still connected to the upper portion 150 of the housing 130, and when flapper 135 is positioned on flapper seat 158. Locking outcrops 154 may be positioned on the distal end of lower portion 150 below the distal end 126 of insert 120.

Locking outcrops 154 may increase an outer diameter of the lower portion 150 such that a diameter of locking outcrops 154 is larger than that of distal end 126. Due to locking outcrops 154 being larger in size than that of the outer diameter of the distal end 126 and internal diameter of the lower end of insert 120, locking outcrops 154 may restrict the movement of lower portion 150 in a second direction relative to insert 120, wherein the second direction is an opposite position from the first direction. This may assist in the disengaging the upper portion 140, flapper 135 and flapper pin 137 from the lower portion 140 when there is a flow back through tool 100. Further, by restricting lower portion 150 from moving in the second direction using locking outcrops 154 and the first direction using ledge 122, the lower portion 150 can be milled with the downhole tool as an integral piece. Hence facilitating milling operation if needed.

Tapered sidewall 156 may be a slanted sidewall that is configured to be positioned on slanted sidewall 124 of insert 120 after lower portion 150 is sheared from upper portion 140.

Flapper seat 158 may be positioned between stress points 146 and locking outcrops 154. Flapper seat 158 may be configured to reduce the inner diameter across lower portion 150, such that flapper 135 may be positioned on flapper seat 158. Responsive to flapper 135 receiving pressure above the flapper 135 in the first direction, flapper 135 may translate these forces to lower portion 130 through flapper seat 158, which may shear stress points 146.

Figure 2:
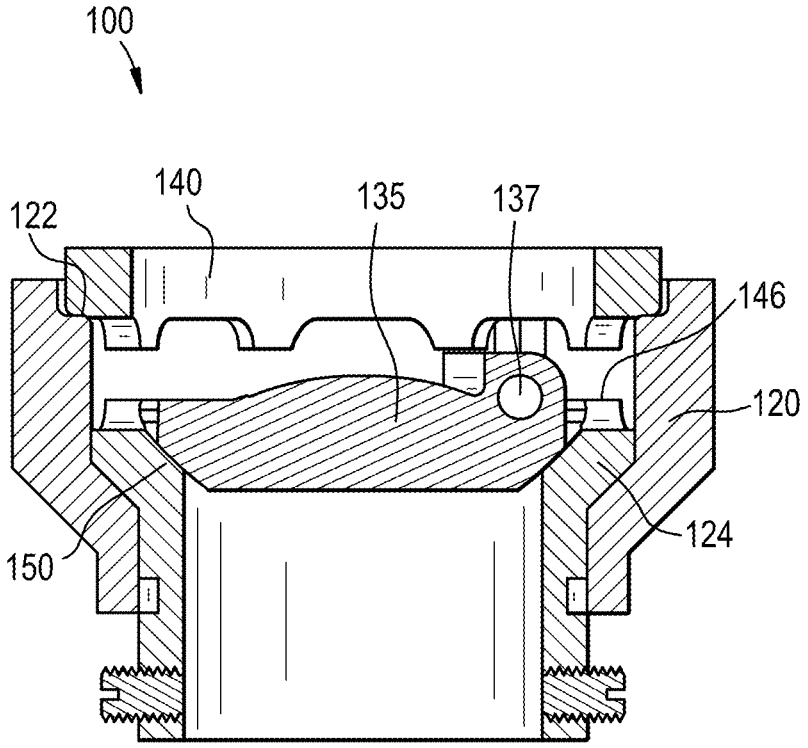
FIG. 2 depicts a downhole tool, according to an embodiment.

FIG. 2 depicts a downhole tool 100, according to an embodiment. Elements depicted in FIG. 2 may be described above, and for the sake of brevity a further description of these elements is omitted. Once tool 100 is set at a desired depth with flapper 135 being in the closed position, a pressure above flapper 135 may increase past the stress threshold. Responsive to pressure in a first direction, flapper 135 may apply a pressure against stress points 146 that is greater than a stress threshold. This may cause stress points 146 to break. When stress points 146 break, upper portion 140 and lower portion 150 may become decoupled.

When the pressure is applied stress points 146 via flapper 135, to decouple upper portion 140 and lower portion 150, lower portion 150 may slide in the first direction. However, due to the restriction created by ledge 122, upper portion 140 may not be able to move in the second direction.

Furthermore, lower portion 150 may slide downhole creating a gap between upper portion 140 and lower portion 150. Yet, because of sloped sidewall 124 the movement of lower portion 150 in the first direction may be limited. As such, after stress points 146 break, both upper portion 140 and lower portion may be separated from each other but still retained within insert 120. Further, flapper 135 will continue to isolate pressure above from pressure below as it will continue to be seated on flapper seat 158. In other embodiments, insert 120 may be the mandrel 110.

Figure 3:
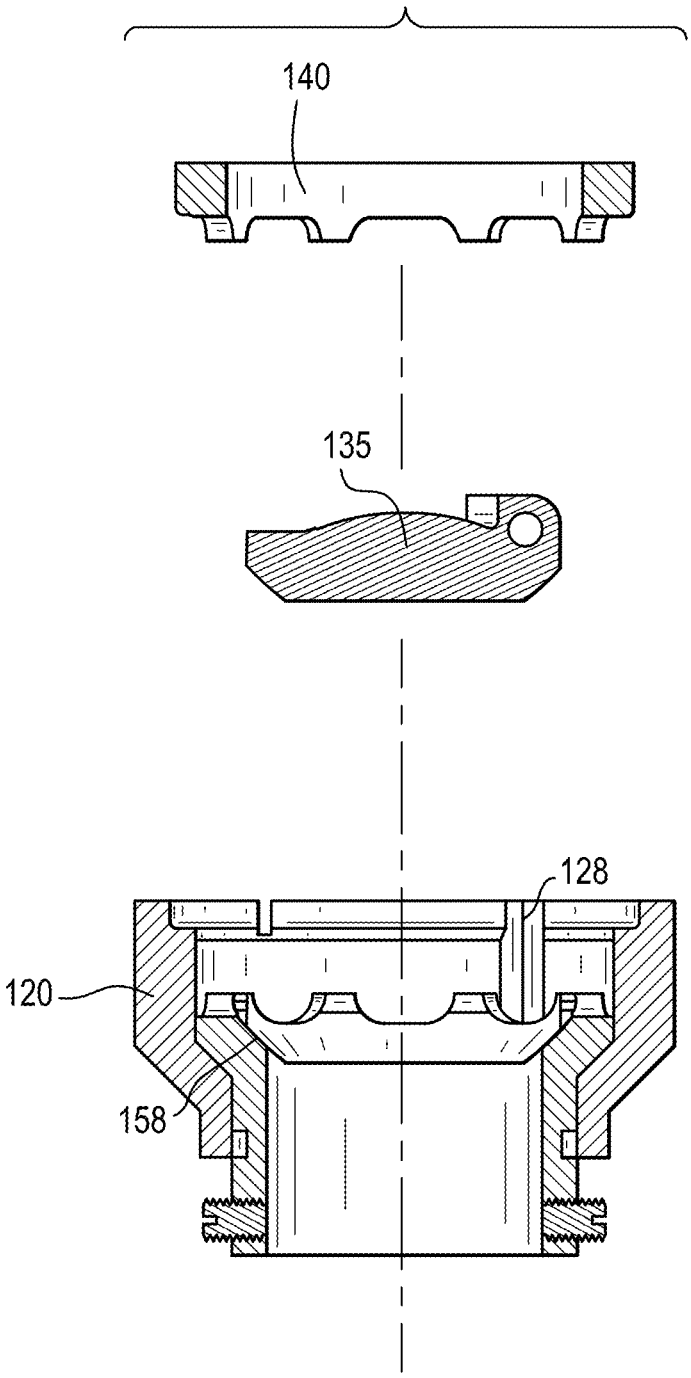
FIG. 3 depicts a downhole tool, according to an embodiment.

FIG. 3 depicts a downhole tool 100, according to an embodiment. Elements depicted in FIG. 3 may be described above, and for the sake of brevity a further description of these elements is omitted. After upper portion 140 and lower portion 150 are decoupled from each other and there is fluid flowing through tool 100 in the second direction, upper portion 140, flapper 135 and flapper pin 137 may be removed from insert 120.

When flapper 135, flapper pin 137 and upper portion 140 move in the second direction, lower portion 150 may remain within insert 120 and/or the mandrel 110 due to locking outcrops 154.

In embodiments, based on the geometry of flapper 135, flapper pin 137 and upper portion 140 it will be extremely unlikely or not statistically possible for flapper 135 and flapper pin 137 to be reinserted into pin slots 128 and seal on flapper seat 158. Furthermore, because flapper 135 may be formed of a dissolvable material over time it may become impossible for flapper 135 to seal across housing 130 due to its decrease in size.

Figure 4:
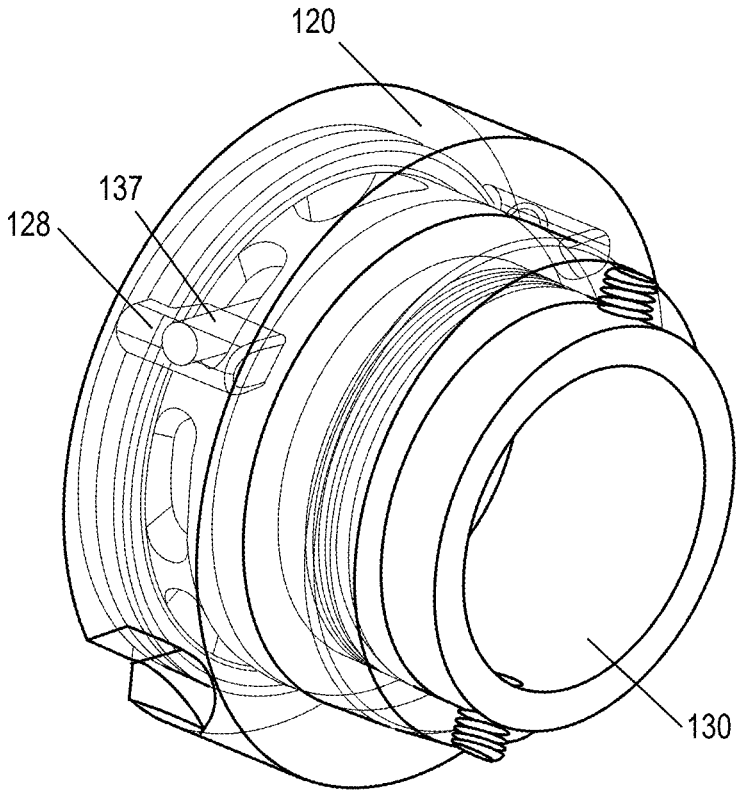
FIGS. 4 and 5 depict a perspective view of an insert and housing, according to an embodiment.
Figure 5:
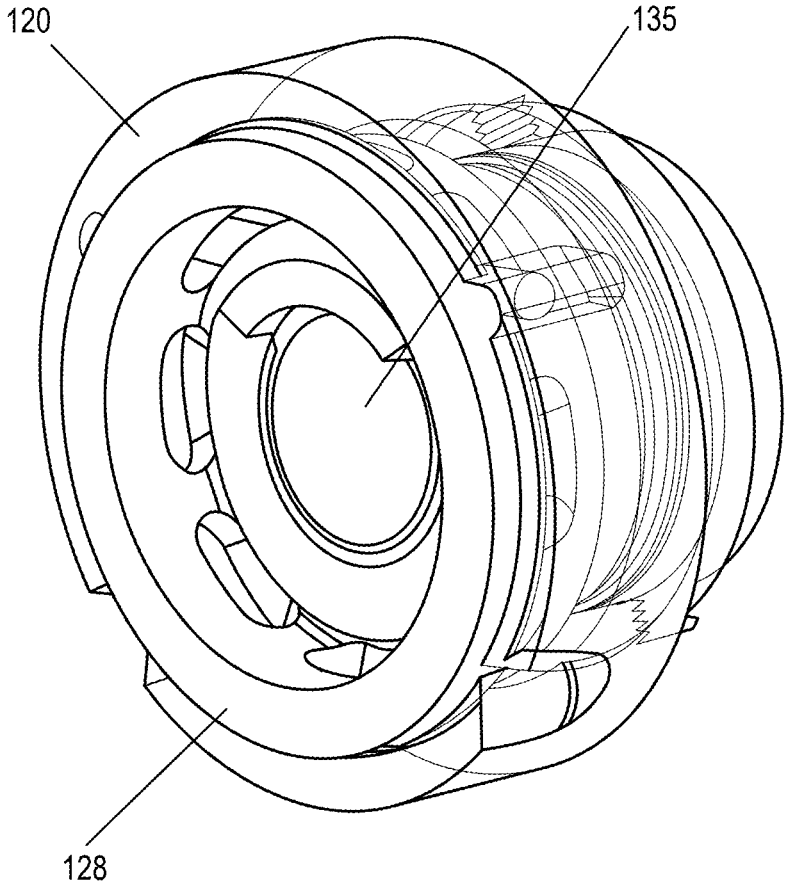

FIGS. 4 and 5 depict a perspective view of insert 120 and housing 130, according to an embodiment. Elements depicted in FIGS. 4 and 5 may be described above, and for the sake of brevity a further description of these elements is omitted. As depicted in FIGS. 4 and 5 pin slots 128 within insert 120. Pin slots 128 may extend from an upper end of insert 120 towards the lower end of insert. However, when upper portion 140 is coupled with lower portion 150, upper portion 140 may restrict the upward movement of pin 137 of flapper 135, such that flapper 135 may remain within insert until upper portion 140 is decoupled from lower portion 150.

Furthermore, as depicted in FIGS. 4 and 5, housing 130 may include a series of windows/gaps that separates stress points 146 from each other's. These gaps may be used to control the width of the stress points 146, which may control the threshold of its shearing/failing, further these windows may allow flapper pin 137 to be inserted through housing 130 and into pin slots 128 which is part of insert 120. In other embodiments, slot 128 may be directly engraved into mandrel 100.

Figure 6:
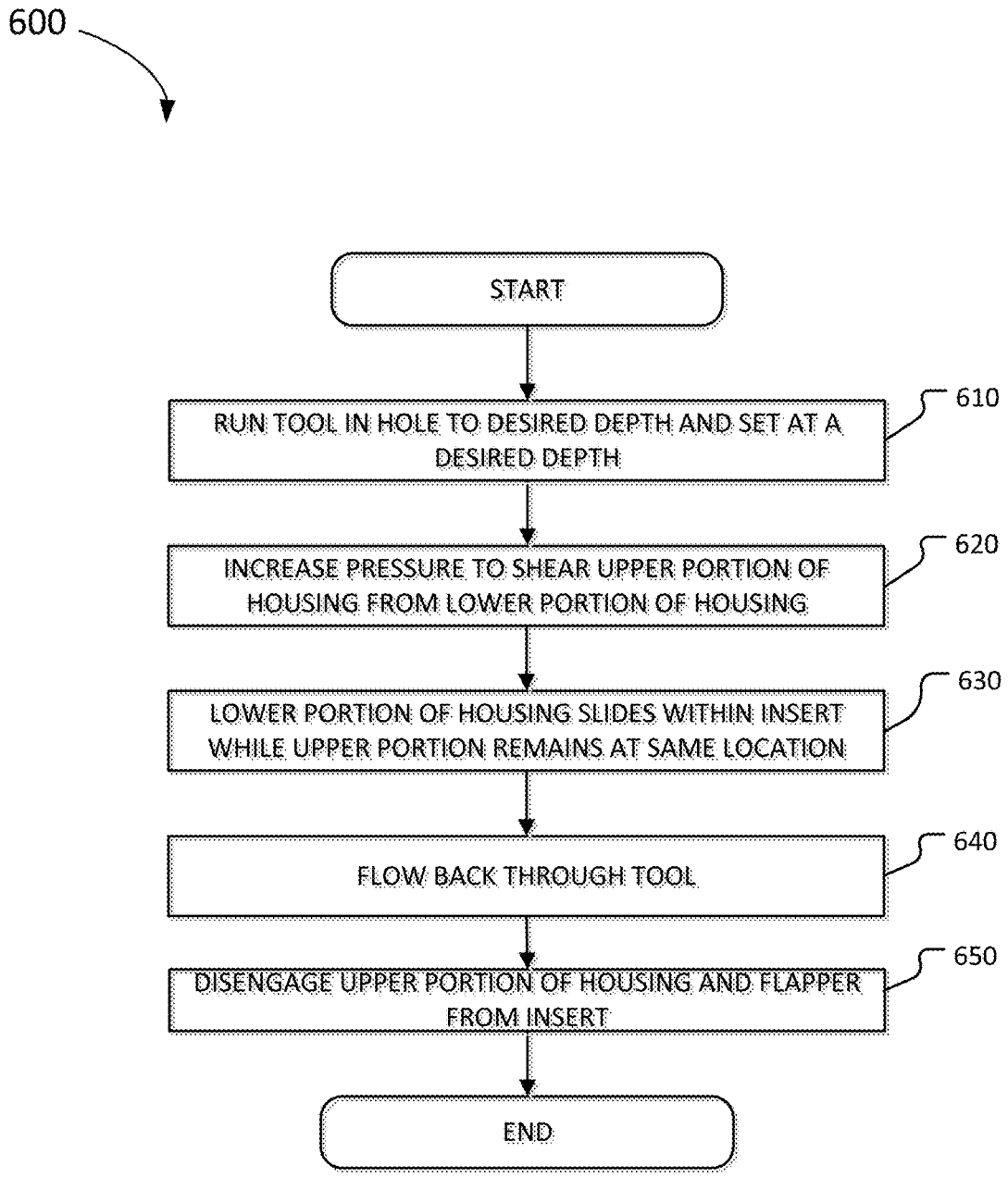
FIG. 6 depicts an operation sequence for shearing a housing with an object, according to an embodiment.

FIG. 6 depicts an operation sequence for shearing a housing with a flapper, according to an embodiment. The operational sequence presented below is intended to be illustrative. In some embodiments, operational sequence may be accomplished with one or more additional operations not described, and/or without one or more of the operations discussed. Additionally, the order in which the operations of operational sequence are illustrated in FIG. 6 and described below is not intended to be limiting.

At operation 610, a downhole tool may be run in hole and set at desired depth. The downhole tool may be run in hole with a flapper being in a closed position across a housing.

At operation 620, the pressure above the flapper may be increased past a stress threshold by applying pressure in a first direction, wherein the first direction may be downhole. This pressure translates forces to stress points via the flapper.

At operation 630, based on the stress threshold and pressure applied to the stress points via the flapper, an upper portion of the housing may be decoupled from the lower portion of the housing while both the upper portion and the lower portion are encompassed by an insert. While both the upper portion and the lower portion are encompassed by the insert, an area above the flapper may still be isolated from an area below the flapper even after the upper portion and the lower portion are decoupled from each other.

At operation 640, fluid may flow or pressure increase in the second direction and interface with the flapper positioned within the insert.

At operation 650, based on the fluid flowing in the second direction the flapper, the flapper pin and the upper portion of the housing may flow in the second direction and no longer be engaged or interfaced with the insert. This may allow fluid to flow through the insert and the lower portion of the housing stay engaged with the insert.

Figure 7:
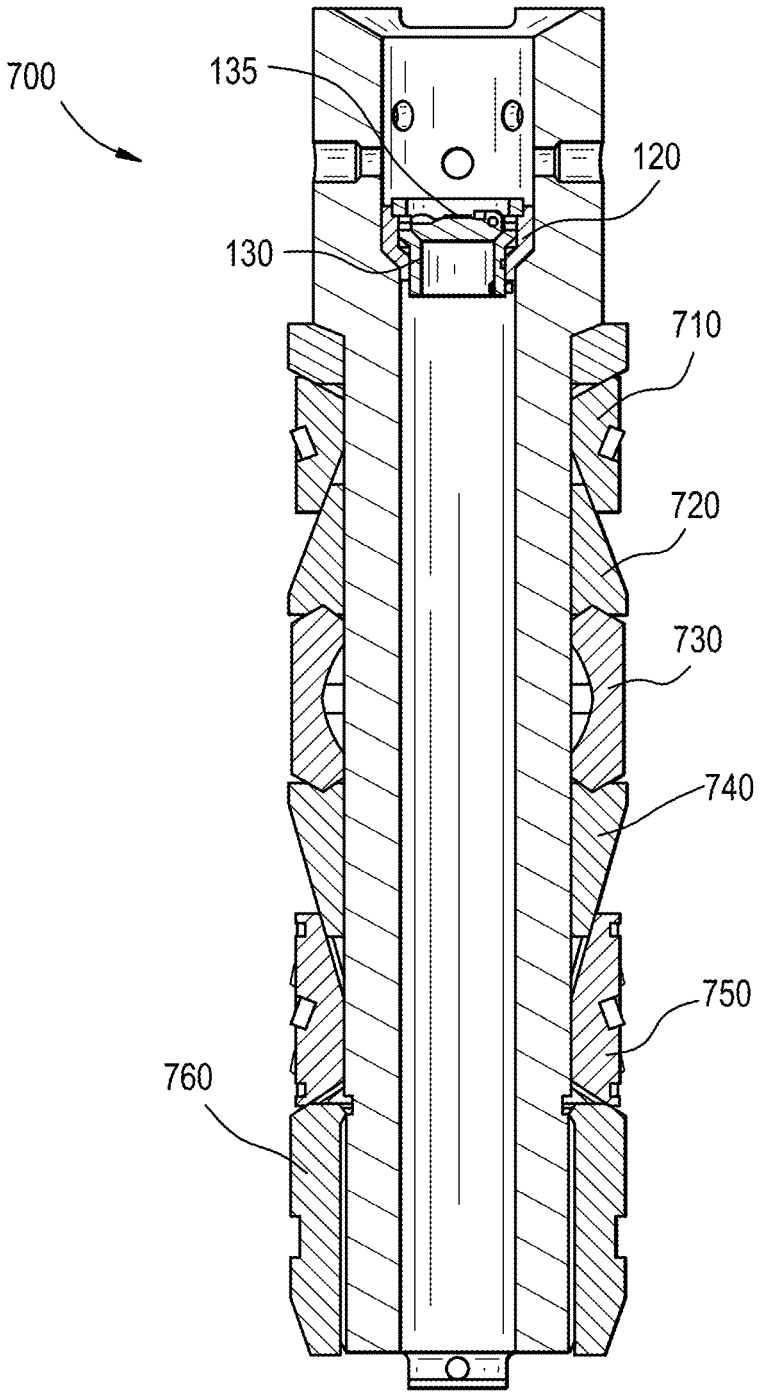
FIG. 7 depicts a downhole tool, according to an embodiment.

FIG. 7 depicts a downhole tool 700, according to an embodiment. Elements depicted in FIG. 7 may be described above, and for the sake of brevity a further description of these elements is omitted.

As depicted in FIG. 7, downhole tool 700 may be a downhole tool with upper slips 710, upper cone 720, packing element 730, lower cone 740, and lower slips 750. In other embodiment upper slips 710 may be eliminated.

The upper slips 710 may be configured to radially expand/break based on the movement of the upper cone 720. The upper cone 720 may be positioned between the upper slips 710 and the packing element 730. The upper cone 720 may be configured to engage with the upper slips 710 to radially expand/break the upper slips 710. In embodiments, the upper cone 720 may be coupled to the mandrel via breakable threads or any other breakable coupling mechanism. The threads on the upper cone may be configured to directly couple the upper cone 720 with the mandrel of the downhole tool to maintain the upper cone 720 in a non-deployed state even with incidental movement from the packing element 730.

The packing element 730 may be a packer/rubber/elastic material that is configured to compress and radially expand across the wellbore. The packing element 730 may be configured to compress based on a pressure differential/forces across the packing element 730 caused by the upper cone 720 and the lower cone 740 trapping these pressures/forces during downhole tool setting and/or while fracing operation above the downhole tool after setting.

The lower cone 740 may be positioned between the packing element 730 and the lower slips 750. The lower cone 740 may be configured to engage with the lower slips to radially expand or break the lower slips. In embodiments, the lower cone 740 may be coupled to the mandrel via breakable threads or any other breakable coupling mechanism. The threads on the lower cone 740 may be configured to directly couple the lower cone 740 with the mandrel of the downhole tool to maintain the lower cone 740 in a non-deployed state even with incidental movement from the lower slips 750 or packing element 730.

The lower slips 750 may be positioned adjacent to the lower cone 740 and cap 760. The lower slips 750 may be configured to radially expand or break based on the movement of the lower cone 740. In embodiments, the lower slips 750 may be coupled to the mandrel via breakable threads or any other breakable coupling mechanism, The threads on the lower slips 750 may be configured to directly couple the lower slips 750 with the mandrel of the downhole tool to maintain the lower slips 750 in a non-deployed state even with incidental movement from the lower cone 740.

As further depicted in FIG. 7, insert 120, housing 130, and flapper 135 may be configured to be mounted on a proximal end of downhole tool 100, between the proximal most end of downhole tool 700 and upper slips 710. This may allow the elements of downhole tool 700 to not be activated until communication is established across housing 130. In other embodiments, insert 120, housing 130, and flapper may be configured to be mounted on a distal end of the downhole tool 100.

Figure 8:
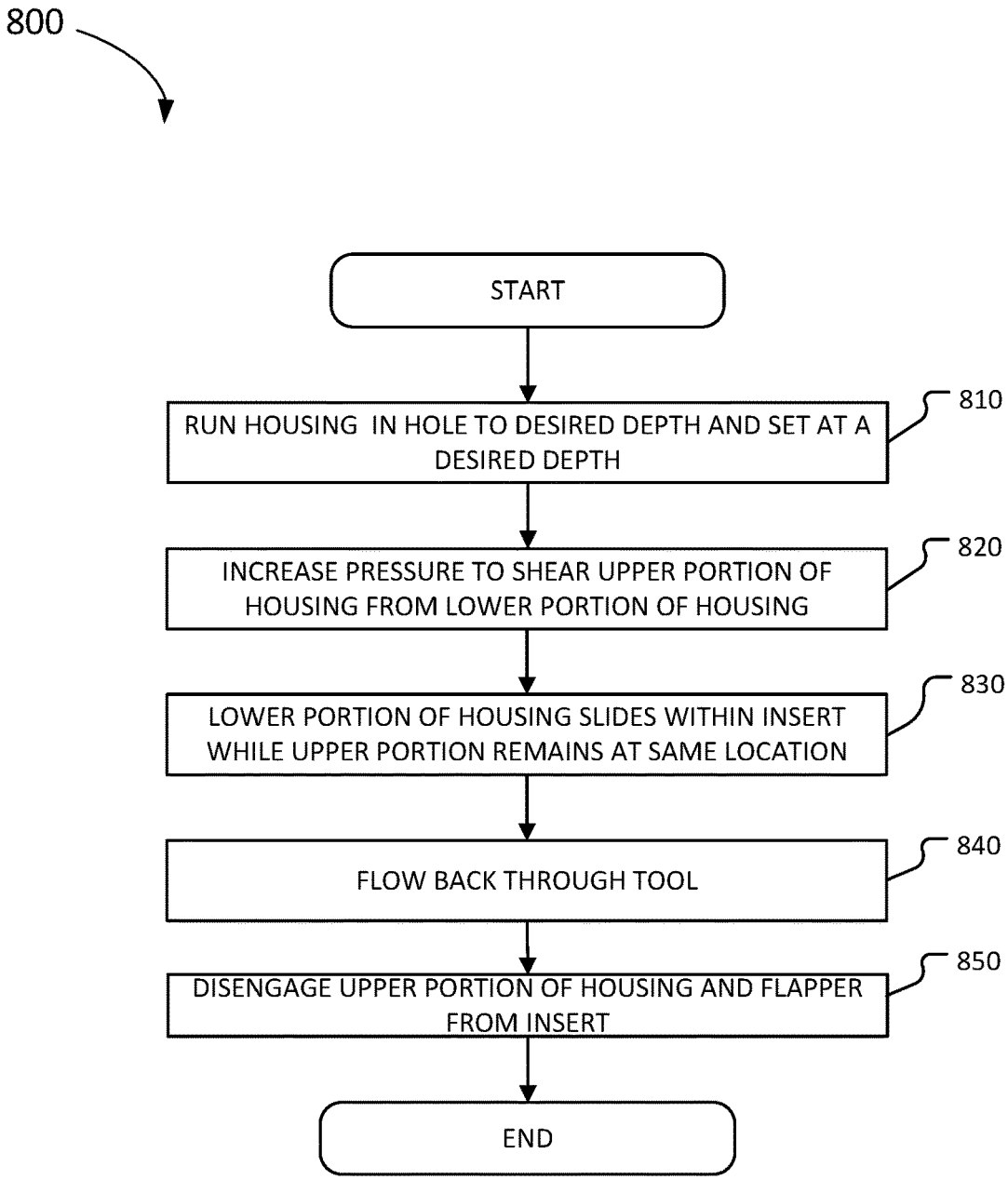
FIG. 8 depicts an operation sequence for shearing a housing with an object, according to an embodiment.

FIG. 8 depicts an operation sequence 800 for shearing a housing with a flapper, according to an embodiment. The operational sequence 800 presented below is intended to be illustrative. In some embodiments, operational sequence 800 may be accomplished with one or more additional operations not described, and/or without one or more of the operations discussed. Additionally, the order in which the operations of operational sequence 800 are illustrated in FIG. 8 and described below is not intended to be limiting.

At operation 810, a shearable housing may be run in hole to a desired depth within a cartridge. For example, the cartridge may land on a toe sleeve or any other casing internal diameter restrictions. The cartridge may be run in hole with a object being in a closed position across the housing. The cartridge may be configured to move downhole within a mandrel until corresponding keys on an outer profile of the cartridge latch with corresponding keys on a profile of the mandrel.

At operation 820, after the cartridge has landing on the mandrel. Pressure above the object may be increased to move a sliding sleeve and open ports to perform a fracturing operation, pressure test casing, etc. When increasing the pressure above the object the pressure may be increased past a stress threshold by applying pressure in a first direction, wherein the first direction may be downhole. This pressure translates forces to stress points via the object.

At operation 830, based on the stress threshold and pressure applied to the stress points via the object, an upper portion of the housing may be decoupled from the lower portion of the housing while both the upper portion and the lower portion are encompassed by the cartridge. While both the upper portion and the lower portion are encompassed by the insert, an area above the object may still be isolated from an area below the object even after the upper portion and the lower portion are decoupled from each other. In embodiments, the upper portion of the housing may be sheared before, after, or during the fracturing operation, as the seal is maintained within the cartridge.

At operation 840, fluid may flow or pressure increase in the second direction and interface with the object positioned within the cartridge.

At operation 850, based on the fluid flowing in the second direction the object, the object and the upper portion of the housing may flow in the second direction and no longer be engaged or interfaced with the insert. This may allow fluid to flow through the insert and the lower portion of the housing stay engaged with the cartridge.

Figure 9:
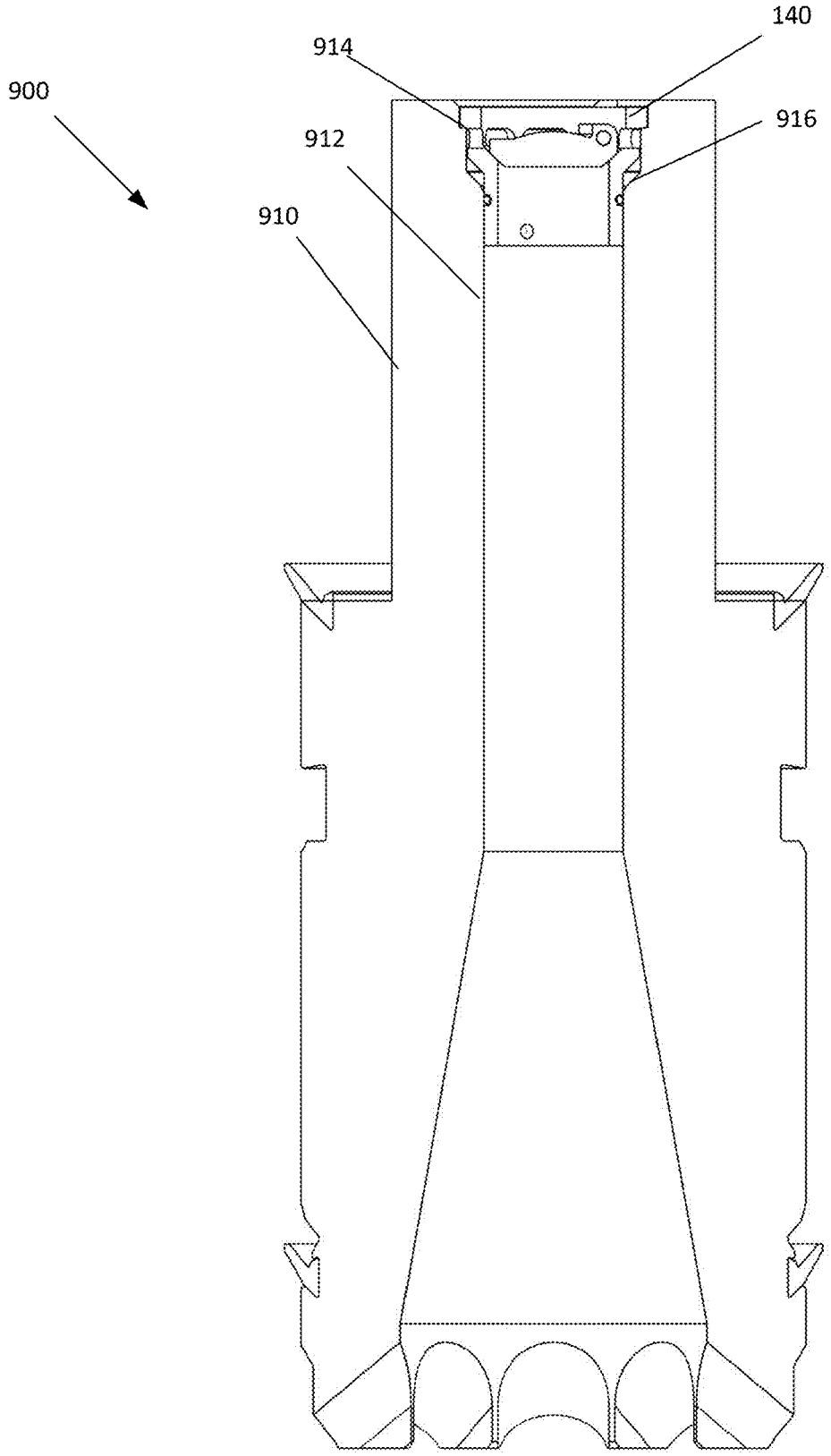
FIGS. 9 and 10 depict a downhole tool, according to an embodiment.
Figure 10:
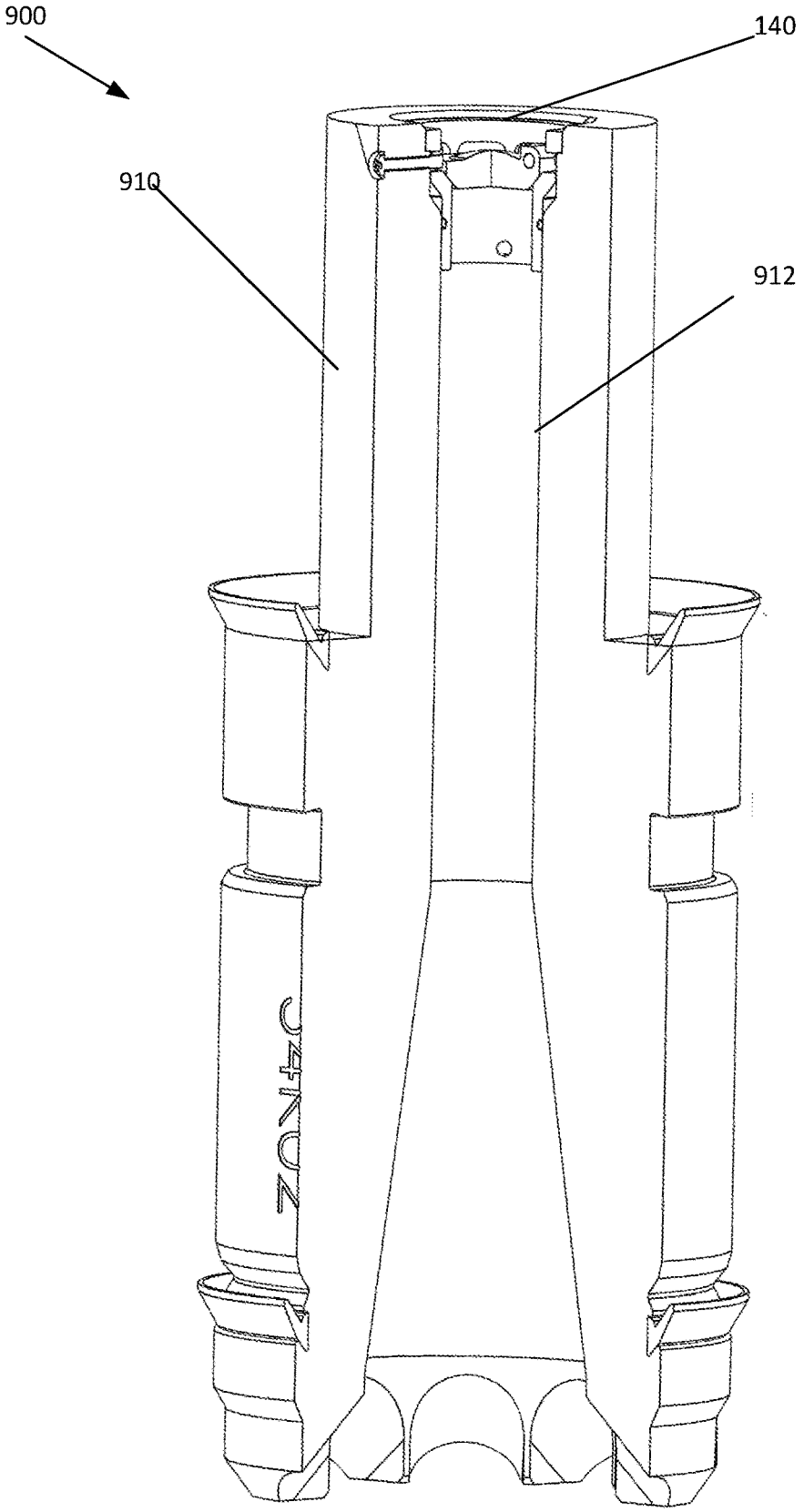

FIGS. 9 and 10 depict a downhole tool 900, according to an embodiment. Elements depicted in FIGS. 9 and 10 may be described above, and for the sake of brevity a further description of these elements may be omitted.

Downhole tool 900 may be frac plug, wiper, cement wiper plug, a casing testing wiper cartridge, pump down plug, cartridge, or any other tool that is configured may be formed of any material including dissolvable material, and may be configured to be positioned downhole. The cartridge may be configured to land on a seat, protrusion, keys, or any other profile within a casing that reduces the inner diameter of the casing, wherein the profile of the inner diameter of the casing may limit the downhole movement of downhole tool 900. In further embodiments, the cartridge may include packers, slips, or other elements that radially expand to limit the downhole movement of downhole tool 900 within the casing. After positioning downhole tool 900 at a desirable location within the well, pressure above the cartridge may increase. The pressure above the cartridge may be able to increase due to object 135 being in the closed position and isolating areas above the cartridge from areas below the cartridge. The increase in pressure may enable testing of the casing to a maximum operating pressure, which may shear housing 130 but still maintain pressure integrity due to object 135 remaining in the closed position even after the shearing of housing 140. In other embodiments, the stem/body may have hole that throttle flow, hence creating differential pressure that allow the lower portion of the housing 130 to break from upper portion and slide in the first direction to isolate the hole(s)

After the pressure testing of the casing, fluid may flow in a reverse direction below the object 135, or pressure maybe bled off above the flapper, which may allow object 135 and the upper portion of housing 130 to be removed from the cartridge. After object 135 is removed from the lower portion of housing 130, pumping may be established through downhole tool 900. In cases the downhole tool 900 was made out of dissolvable material this may allow it to accelerate dissolution due to contaminating fresh fluid.

Similar to insert 120, downhole tool 900 may include ledge 914, sloped sidewall 916, and distal end 912.

Ledge 914 may decrease an inner diameter across downhole tool 900, which may be configured to act as a stopper, no-go, etc. to restrict the movement of an upper portion of housing 130 in a first direction, wherein the first direction may be downhole. Furthermore, ledge 914 may retain upper portion 140 after lower portion 150 is sheared from housing 130.

Sloped sidewall 916 may be configured to gradually decrease the inner diameter of downhole tool 900. Sloped sidewall 916 may be configured to receive lower portion 150 of housing 130 to restrict the movement of lower portion 150 in the first direction after decoupling upper portion 140 and lower portion 150. This may enable object 135 to retain a seal across the cartridge even after shearing lower portion 150 from upper portion 140.

Distal end 912 may be a passageway through downhole tool 900, where fluid may be pumped through after removing object 135 from housing 130. In embodiments distal end 912 may include ports that radially extend through downhole tool 900. The ports may be positioned below lower portion 150 when lower portion 150 is coupled to upper portion 140, and covered by lower portion 150 when lower portion 150 is decoupled from upper portion 140. The ports may be configured to allow circulation between the area above object 135 and the area below object 135 before the shearing of housing 130.

Figure 11:
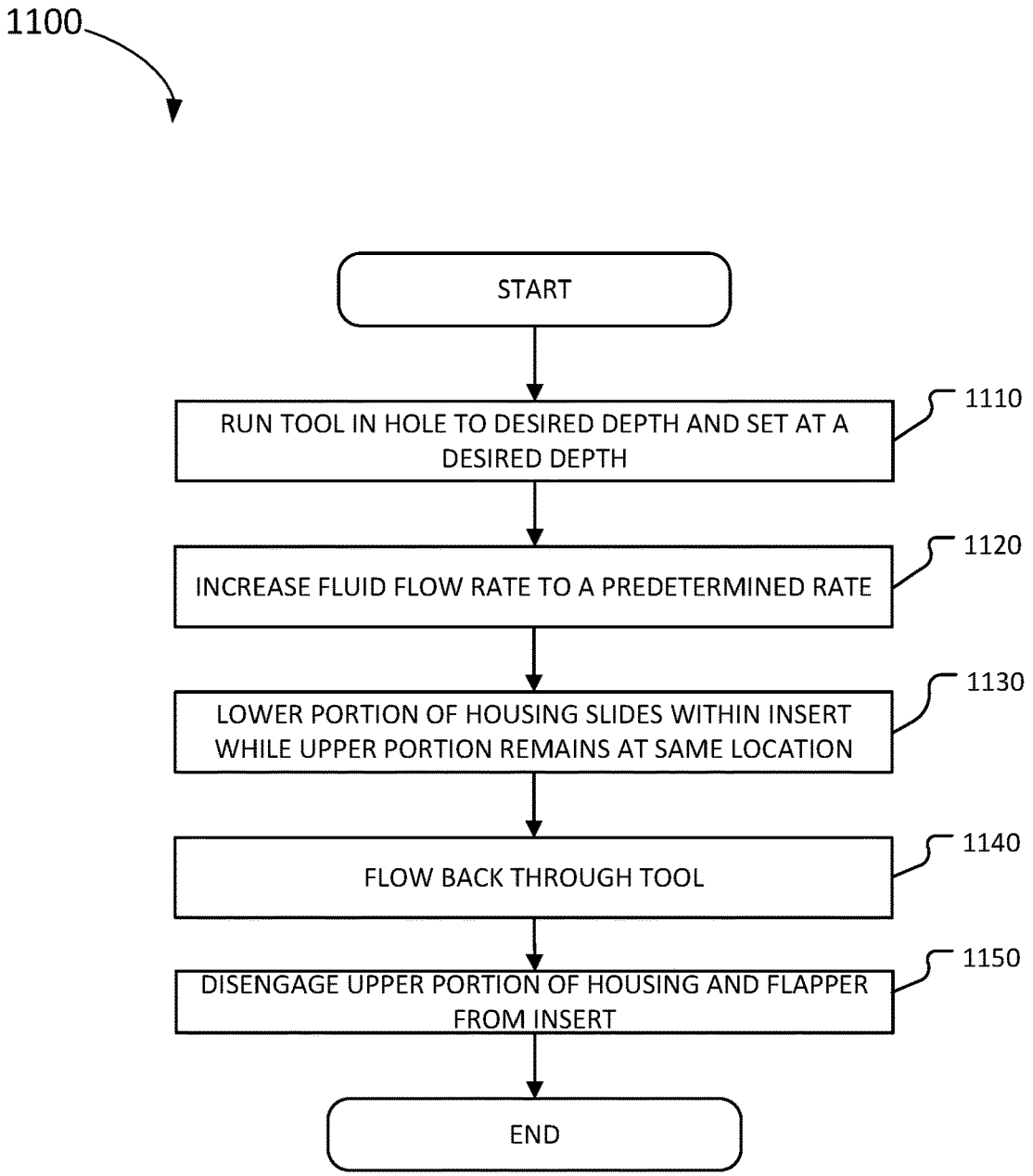
FIG. 11 depicts an operation sequence for shearing a housing with an object, according to an embodiment.

FIG. 11 depicts an operation sequence for shearing a housing with an object, according to an embodiment. The operational sequence presented below is intended to be illustrative. In some embodiments, operational sequence may be accomplished with one or more additional operations not described, and/or without one or more of the operations discussed. Additionally, the order in which the operations of operational sequence are illustrated in FIG. 11 and described below is not intended to be limiting.

At operation 1110, a downhole tool may be run in hole and set at desired depth. The downhole tool may be run in hole with a flapper being in a closed position across a shearing housing.

At operation 1120, the fluid flow rate through the hole may be increased to a predetermined value, which may create the required pressure to shear the shearing housing.

At operation 1130, responsive to the fluid flow rate increasing the predetermined value, the lower portion of the shearing housing may slide downhole within the insert and form a seal while the upper portion remains at a same location within the hole.

At operation 1140, fluid may flow or pressure increase in the second direction and interface with the flapper positioned within the insert.

At operation 1150, based on the fluid flowing in the second direction the flapper, the flapper pin and the upper portion of the housing may flow in the second direction and no longer be engaged or interfaced with the insert. This may allow fluid to flow through the insert and the lower portion of the housing stay engaged with the insert.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

The invention claimed is:

1. A downhole tool comprising:

a coupling device configured to couple an object with the downhole tool by inserting the coupling device into the downhole tool and the object; and a seat within the downhole tool, wherein the object is configured to sit on the seat to isolate a first area from a second area while the object is being run in hole and while the object is coupled with the downhole tool via the coupling device, wherein the object is configured to move in a first, downhole direction by applying pressure against the object, thereby maintaining the seal across the seat by forcing the object across the seat during and after the movement due to the applied pressure, wherein flowing fluid in a second, uphole direction after the movement of the object in the first direction disengages the object from the seat and moves the object such that the object can no longer seal on the seat, wherein the object is not radially positioned within the downhole tool after the object moves in the uphole direction.

2. The downhole tool of claim 1, wherein the object is radially positioned within and mounted to the downhole tool when run in hole.

3. The downhole tool of claim 1, wherein the object is configured to move in the downhole direction when the downhole tool breaks, and the object is configured to isolate the first area and the second area across the seat after moving in the downhole direction.

4. The downhole tool of claim 1, wherein the downhole tool includes a ledge that limits the movement of the object in the first direction.

5. The downhole tool of claim 1, wherein the downhole tool is a frac plug or a wiper plug.

* * * * *